US008459970B2

(12) United States Patent
Johnston

(10) Patent No.: US 8,459,970 B2
(45) Date of Patent: Jun. 11, 2013

(54) HIGH PRESSURE PUMP OF VARIABLE DISPLACEMENT

(76) Inventor: Charles E. Johnston, Moses Lake, WA (US)

( * ) Notice: Subject to any disclaimer, the term of this patent is extended or adjusted under 35 U.S.C. 154(b) by 995 days.

(21) Appl. No.: 12/279,327

(22) PCT Filed: Feb. 26, 2007

(86) PCT No.: PCT/US2007/062806

§ 371 (c)(1),
(2), (4) Date: May 15, 2009

(87) PCT Pub. No.: WO2007/101153

PCT Pub. Date: Sep. 7, 2007

(65) Prior Publication Data

US 2010/0047083 A1 Feb. 25, 2010

Related U.S. Application Data

(60) Provisional application No. 60/777,201, filed on Feb. 27, 2006.

(51) Int. Cl.
*F01C 1/07* (2006.01)

(52) U.S. Cl.
USPC ..... 418/34; 418/160; 417/469

(58) Field of Classification Search
USPC ..... 417/460, 469; 418/34, 160
See application file for complete search history.

(56) References Cited

U.S. PATENT DOCUMENTS

| | | | | |
|---|---|---|---|---|
| 2,821,926 | A | 2/1958 | Miller et al. | |
| 4,645,428 | A | 2/1987 | Arregui | |
| 4,687,408 | A * | 8/1987 | Klambauer | 414/217 |
| 5,634,777 | A | 6/1997 | Albertin | |
| 5,758,609 | A | 6/1998 | Smith | |
| 6,162,030 | A | 12/2000 | Pierrat | |

FOREIGN PATENT DOCUMENTS

GB 1085393 9/1967

OTHER PUBLICATIONS

Supplemental European Search Report dated Aug. 12, 2012.

* cited by examiner

*Primary Examiner* — Charles Freay
*Assistant Examiner* — Patrick Hamo
(74) *Attorney, Agent, or Firm* — Robert A. Seldon

(57) ABSTRACT

A variable-volume pump comprises one or more reciprocating pistons within respective reciprocating cylinders. The phase relationship between the reciprocating piston(s) and the reciprocating cylinder(s) determines the volumetric output of the pump.

16 Claims, 3 Drawing Sheets

HIGH PRESSURE PUMP OF VARIABLE DISPLACEMENT

TECHNICAL FIELD

The present invention relates to fluid pumps and, more particularly, to high pressure fluid pumps.

BACKGROUND ART

High pressure pumps such as hydraulic intensifier pumps are widely used for applications such as waterjet cutting and abrasivejet cutting that require the delivery of a high pressure of water or other fluids including but not limited to liquids, liquid mixtures, gases and gaseous mixtures. As used herein, the term high pressure shall mean pressure in excess of approximately 3500 psi. For the sake of simplicity, this invention will be described in the context of a high pressure water pump, although those skilled in the art will recognize that this invention is not limited to any particular fluid or fluidic mixture. Similarly, it should be recognized that, although this invention is described in terms of its application to high pressure pumps for a waterjet or abrasivejet cutting system, its application is not so limited, and the invention herein is not restricted to high pressure pumps for any particular application or media.

The high pressure pump of a waterjet or abrasivejet cutting system produces high pressure water that is conducted to the jet-forming orifice of a waterjet or abrasivejet cutting head. As is known in the art of waterjet and abrasivejet (hereinafter, collectively, waterjet) cutting systems, a high velocity waterjet is formed by compressing the water to an operating pressure of 3,500 to 150,000 psi (238 10,204 bars), and forcing the high pressure water through a jet-forming orifice having a diameter of between 0.003-0.040 inches (0.08 1.02 mm).

Historically, high pressure pumps used in waterjet systems are either direct-drive or intensifier type. A direct-drive high pressures pump employs high pressure pistons which are mechanically linked to a drive mechanism. The drive mechanism normally comprises a crank mechanism, connecting links and a power source that rotates the crank. The power source employed is electric, gasoline or diesel for most applications. Direct-drive pumps are normally very efficient (e.g., in the 90% range), in terms of the required power input for producing useful power in the form of pressurized cutting fluid. Current direct-drive high pressure pumps, however, have little or no variation of volumetric flow and are therefore restricted in their ability to safely and successfully power a wide range of orifice sizes at optimum cutting pressure.

An intensifier-type high pressure pump includes a cylinder, a hydraulic working piston, a high pressure piston, inlets for a hydraulic working fluid to both advance and retract the working piston, a water inlet for the ingress of water to be pressurized, and a water outlet for the egress of the pressurized water. In operation, a relatively low-pressure hydraulic fluid is applied to the comparatively large working piston. The working piston, in turn, drives the smaller high-pressure piston. The resulting water pressure is the hydraulic pressure multiplied by the ratio of the hydraulic and high-pressure piston areas.

Intensifier-type high pressure pumps are capable of producing variable volumetric flow coupled with constant working pressure. This allows the user to power a large range of orifice sizes at the optimum working pressure. However, the intensifier type system is not efficient in terms of the power input required for useful power produced in the form of useful pressurized cutting fluid. Efficiencies in the range of sixty to seventy five percent are typical.

The fluid to be intensified (e.g., water) is typically delivered to the intensifier pump via an inlet check valve from a low-pressure fluid supply. The fluid supply is generally is able to generate sufficient pressure to overcome the tension of an internal poppet spring within the check valve, opening the check valve when the intensifier piston is in the intake portion of its cycle, thereby allowing the fluid to be drawn into the intensifier pistons cylinder. When the intensifier piston enters the compression portion of its cycle, the pressurized fluid within the cylinder closes the inlet check valve and is thereby prevented from back flowing into the low pressure supply side of the pump. The pressurized fluid is subsequently expelled from the cylinder by opening an outlet check valve with the increased fluid pressure through compression, and flowing the pressurized water out into the system.

In many cutting facilities, a single intensifier pump is used to feed pressurized water to the jet-forming orifices of a plurality of cutting heads. As the cutting heads are selectively activated and deactivated during their respective cutting operations, or as one or more cutting heads are brought on line or taken off line, the fluctuating volumetric demand for water causes pressure variations in the line; i.e., pressure drops in the line as more water is required, and increases as demand lessens. This requirement has led to a world-wide predominance of variable volume intensifier-type high-pressure pump installations for waterjet applications. The variable volume intensifier-type high-pressure pump has more than compensated for lower operating efficiencies through better reliability, compared to the direct drive pumps now in use in the waterjet cutting industry.

Industrial applications require precise fluid delivery, and pressure fluctuations are accordingly undesirable because the rate, ability and quality of the cutting process can be detrimentally affected. Thus a slowly reciprocating intensifier-type high pressure-pump requires the employment of a vessel capable of holding approximately 100 cubic inches of cutting fluid (e.g., water) at the working pressure to smooth fluctuations in the working pressure of the cutting fluid. Such vessels are referred to as accumulators or shock attenuators. These vessels are expensive, with costs for the end user near (US) $10,000 for a 100 cubic inch (i.e., approx. 1.64 liters) unit.

Direct-drive high-pressure pumps are normally constructed with three or more high pressure cylinders operated at relatively high cycle speeds which smooth the working pressure without the need of the expensive accumulator. Thus, it can be much more economical to manufacture the relatively higher efficiency direct-drive high-pressure pump rather than the relatively lower efficiency intensifier-type pump for this reason as well.

DISCLOSURE OF INVENTION

A pump constructed in accordance with the invention comprises a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder axially, and means for adjusting the phase relationship between the cylinder and piston movements to adjust the volumetric output of the pump to generally maintain a desired value of the fluid pressure in the pressurized-fluid line. By varying the relative motion of the piston to the cylinder, the volumetric output of the pump is controlled while maintaining the desired value of the liquids working pressure.

The invention herein may also be employed in a power-producing device of variable volume such as an internal combustion engine (ICE), wherein a gas and/or gas-liquid mixture enters the cylinders, is burned to produce mechanical energy, and exits the cylinders. A variable volume ICE, for example, can be utilized to optimize mileage and/or minimize emissions under various operating conditions.

A power-producing device constructed in accordance with the invention comprises a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder axially, and means for adjusting the phase relationship between the cylinder and piston movements to adjust the volumetric output of the device to generally maintain a desired value of a monitored parameter.

Further details concerning the invention will be appreciated from the following detailed description of the invention, of which the drawing is a part.

BEST MODE FOR CARRYING OUT THE INVENTION

Figure 1:
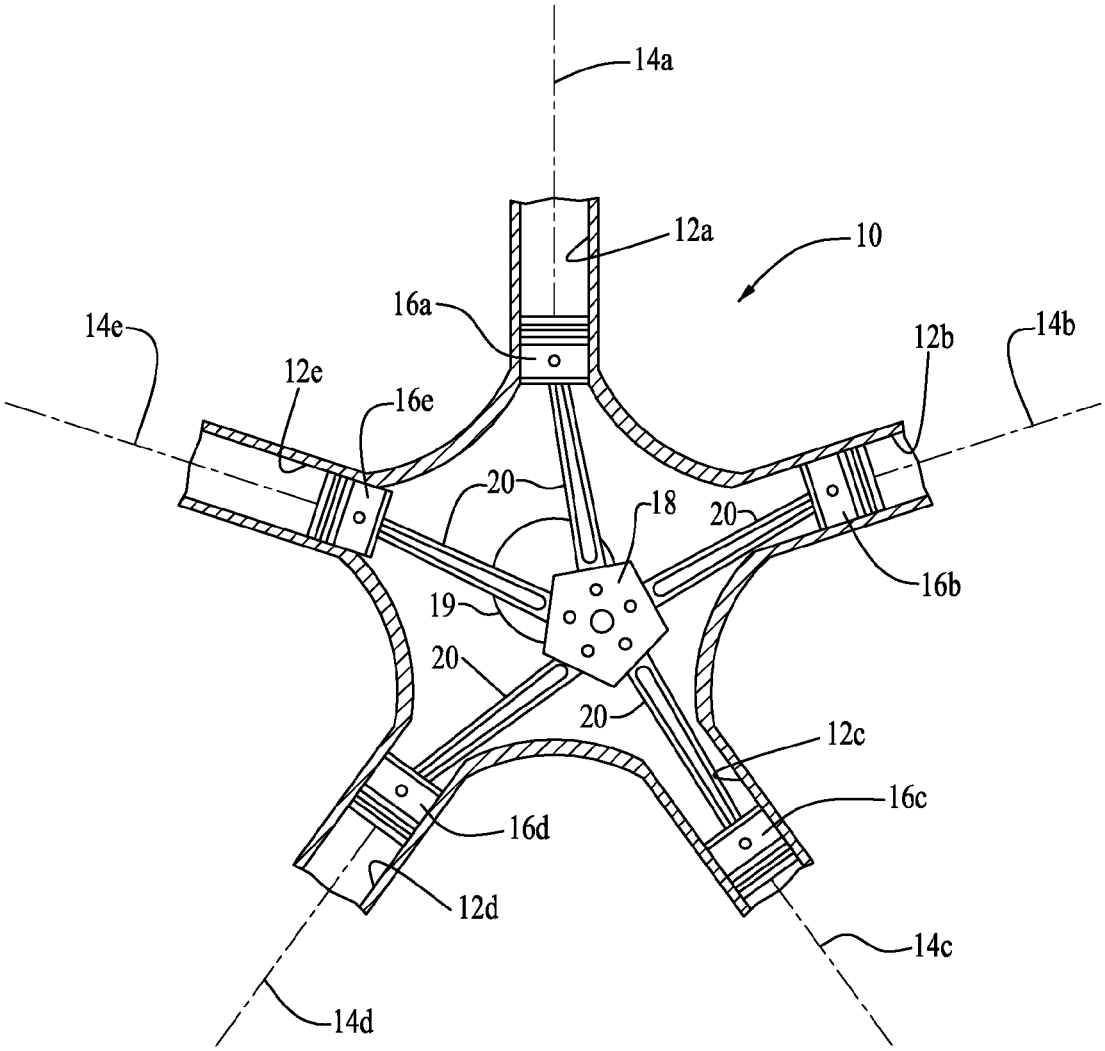
FIG. 1 PRIOR ART
FIG. 1 is a schematic illustration of a conventional radial pump.

FIG. 1 is a schematic illustration of a conventional radial pump. The pump comprises a body 10 having a plurality of cylinders 12*a-e* extending along respective axes 14*a-e*. A high pressure piston 16*a-e* is reciprocally movable within each cylinder between a first position within the cylinder (as illustrated with piston 16*a*) and a second position within the cylinder (as illustrated by piston 16*c*).

Inlet means (not illustrated) associated with each cylinder permits the ingress of a liquid into the cylinder as the piston moves away from the second position towards the first position Outlet means (not illustrated) associated with each cylinder permit the egress of the liquid from the cylinder into a pressurized-fluid line (not illustrated) after the liquid has been pressurized by the movement of the piston away from the first position towards the second position.

Means are provided for reciprocally moving each piston in its respective axial direction within its respective cylinder. Here, causation means, such a motor (not shown), drives a rotating hub 19 to which a crank plate 18 is eccentrically mounted. The crank plate 18, in turn, is coupled to each piston through a respective connecting rod 20. As the hub rotates, the crank plate 18 operated through the connecting rods 20 of each piston to reciprocally move the pistons within their respective cylinders in the respective axial directions.

As is known in the art, the connecting rods 20 are mounted to the crank plate 18 with linkage means, such as respective pins, that allow the proximal end of the rods (i.e., the ends next to the crank plate) to undergo rotational movement with the plate while the distal ends of the connecting rods rotate in the respective pistons and move axially with the pistons.

Alternatively, a cam can be mounted for rotation with the hub (or instead of the hub), with reciprocating movement being imparted to the pistons by cam followers mounted or coupled to the proximal ends of the connecting rods so as to follow the contoured periphery of the cam.

Figure 2B:
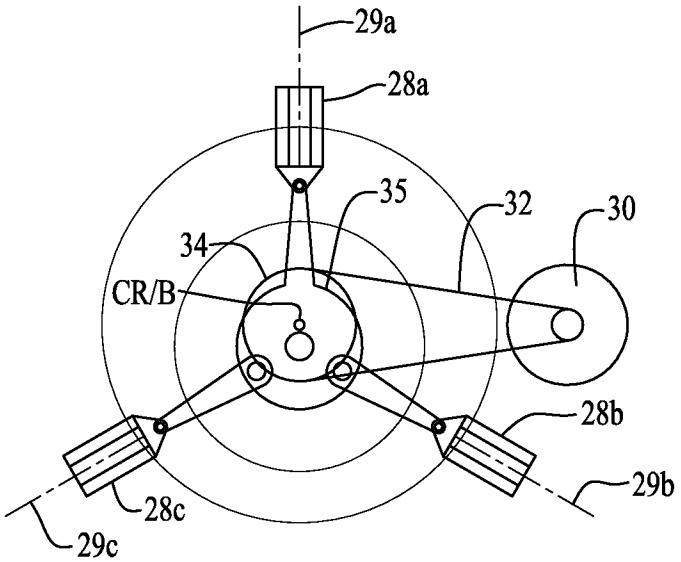
FIGS. 2A and 2B schematically illustrate a pump system constructed in accordance with the invention.
Figure 2A:
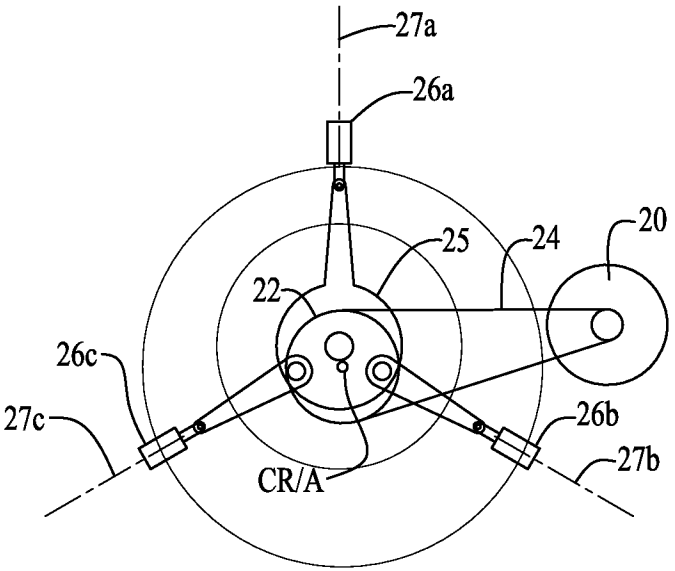
Figure 3A:
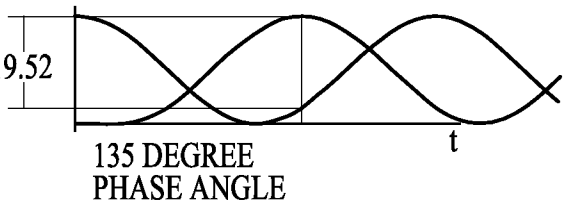
FIG. 3 graphically illustrates volumetric flow versus phase differential for such an arrangement.
Figure 3B:
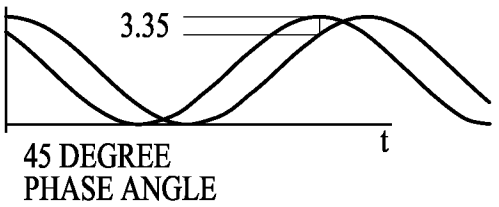
Figure 3C:
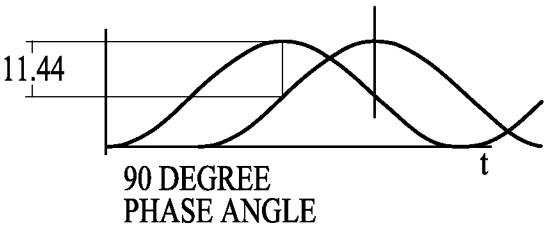
Figure 3D:
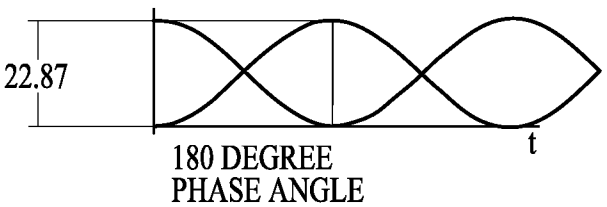

FIGS. 2A and 2B schematically illustrate a pump system constructed in accordance with the invention. FIG. 2A illustrates a first motor 20 coupled to a rotating drive shaft 22 via a drive belt 24 to drive a crank plate 25 which in turn imparts linear motion to the pistons 26*a*, 26*b*, 26*c* of a three-piston pump through connecting rods 27. Each of the pistons 26*a-c* moves reciprocally within a respective cylinder 28*a-c*, schematically illustrated in FIG. 2B. A second motor 30 drives the cylinders 28*a-c* through connecting rods 29 in a reciprocating manner axial to the pistons 26*a-c* therein. The second motor 30 drives the cylinders 28*a-c* via a drive belt 32, rotating drive shaft 34 and crank plate 35. The rotating drive shaft 34 is located concentric to rotating drive shaft 22. This allows one to control the phase of motion of each cylinder and related piston relative to one another as the cylinders are reciprocally driven in their respective axial directions along axes 29*a-c* respectively.

Thus, both the cylinders and the pistons are driven by a respective radial crank plates and connecting rod assemblies, with the preferred centers of rotation being common for both. If the two crank plates are provided with independently adjustable power sources, such as separate servo motors, the phase of the piston to its respective cylinder can be controlled to create a variable volumetric output. For example, if the two power sources are synchronized at zero degrees (i.e., there is no relative movement between a piston and its cylinder), there will be zero liquid flow out of the cylinders because there is no relative motion between each piston and its respective cylinder. Likewise, maximum volumetric flow is obtained when each piston and its respective cylinder are 180° out of phase. It can be noted that, in this embodiment, the first and second positions of the piston are constant with respect to a fixed point in space, but vary with respect to the cylinder in accordance with the phase relationship; e.g., the first and second positions are essentially the same with respect to the cylinder when the phase is zero degrees.

FIG. 3 graphically illustrates volumetric flow versus phase differential for such an arrangement. In accordance with the invention, the phase differential of each piston and associated cylinder is a function of the monitored fluid pressure in the liquid being outputted from the pump. A pressure-sensing means (not illustrated), such as a transducer, is conveniently installed in the high-pressure liquid line leading from the output of the pump; as is known in the art, the high pressure line of a waterjet cutting system leads form the pump to the waterjet cutting head(s). The output signal from the pressure-sensing means is inputted to a control unit that signals one or both motors 20, 30 to change the phase angle of the piston(s) and cylinder(s) and thereby vary the volumetric flow in a manner that maintains the liquid in the high-pressure line at a substantially constant pressure as the flow demanded by the waterjet cutting head(s) varies.

Thus, the phase relationship of the cylinder and its piston is automatically adjusted to maintain the liquid pressure at a chosen value as volumetric flow varies. Those skilled in the art will recognize that the varying of the phase angle can be accomplished with any desired mechanism, whether mechanical, hydraulic, pneumatic, electric or any other available means, and is not limited to the aforedescribed components. Further, the invention is not limited to any particular number of pistons and cylinders, and the piston/cylinder arrangement need not be radially disposed, as illustrated, but can be of any desired configuration.

Numerous other means for adjusting and/or controlling the phase relationship of the high pressure pistons versus the high pressure cylinders are available for application to this mechanism. For example, one can use a single drive source applied to two cams rotated simultaneously by the common drive source. The first of the cams is preferably coupled directly to the drive source. The second of the cams is then driven by the first cam with an adjustable coupling responsive (directly or indirectly) to the pressure variation in the high pressure line to vary the phase relationship between the two cams. The pistons and cylinder bodies are coupled to cam followers responsive to the varying contours of respective cams to experience reciprocating movement.

Many variations of the preferred embodiment can be implemented without departing from the scope of the invention. For example, a simple form of the single drive-source configuration described in the previous paragraph provides a manually adjustable coupling mechanism for adjusting the relative phase of the two cams. Manual adjustment can, for example, be accomplished during stationery time, and create a constant volumetric output during rotational operation. This simple configuration can be made automatic by powering the coupling with hydraulic, electric or pneumatic means, or by tapping into the rotational motion of the cam device utilizing mechanical linkage such as planetary gearing, or in any of numerous other ways.

Alternatively either the pistons or the cylinders can be driven by a constant speed motor, and the other of the pair can be incrementally driven by a servo motor or other means for adjusting the relative position of the reciprocating piston within the cylinder in response to the feedback signal from the pressure sensing means. In this way, the volume of the liquid drawn into and compressed within the cylinders varies with pressure to maintain the desired working pressure level.

The preferred configuration can use two drive sources can operate with two adjustable speed/position motors, or a single constant speed motor in conjunction with an adjustable speed/position motor, or a single motor and a phase-adjustable crank plate that is adjustable relative to a second crank plate, both being powered by the same motor. In the last alternative, the motor is preferably a constant speed motor.

An advantage in the use of reciprocating cylinders together with reciprocating pistons is that the pistons can draw a volume of liquid into the cylinders that exceed the volume that would be drawn by a piston with the same stroke in a stationary cylinder. As illustrated in FIG. 3, a piston having an effective stroke of 11.44 inches (29 cm) that reciprocates within a reciprocating cylinder having a stroke of 11.44 inches (29 cm) will (when the piston and cylinder are 180° out of phase) draw the same volume of liquid into the cylinder as a piston with a 22.88 inch (58 cm) stroke operating within a stationary cylinder. Consequently, a shorter piston stroke and/or bore can be used to provide a desired volumetric flow, yielding smaller pump dimensions, lighter weight, greater efficiency, more powerful low profile cams, lower operating speeds than current direct drive high pressure pumps, longer high pressure seal life, lower manufacturing costs, elimination of the expensive shock attenuator and ease of adding additional cylinders and thus power output. By way of example the increase in efficiency will enable a 30 hp (22 kw) pump constructed in accordance with the invention to be utilized in a waterjet cutting system in lieu of a 50 hp (37 kw) intensifier pump, with attendant savings.

Those of ordinary skill in the art will recognize that pressure-sensing of the liquids working pressure can be performed in regions other than the high pressure line leading to the waterjet cutting head, and that other cylinder configurations can be used without departing from the scope of the invention. In addition, it will be recognized that the foregoing invention can be applied to power-producing devices of variable volume such as an internal combustion engine. In the internal combustion engine, for example, the motor depicted in FIG. 1 is omitted; instead, a gas or gas/liquid mixture enters the cylinders and is compressed by a respective piston, whereupon combustion takes place within the cylinder to provide the mechanical energy. The reciprocating movement of the piston(s) within the respective cylinder(s) is the same, and the invention herein may accordingly be applied in generally the same manner has described herein, with the goal of monitoring and optimizing the engines operating characteristic of interest (e.g., fuel efficiency or emissions) with an appropriate sensor in the appropriate line.

Although the present invention and its advantages have been described in detail, it should accordingly be understood that various changes, substitutions and alterations can be made herein without departing from the spirit and scope of the invention as will be defined in the future by appended claims.

I claim:

1. A pump comprising:

a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder body axially, and means for adjusting the phase relationship between the cylinder body and piston movements to generally offset pressure changes in the pressurized-fluid line.

2. The pump of claim 1 wherein the adjusting means is manually actuated.

3. The pump of claim 1 wherein the adjusting means is responsive to the pressure in the pressurized-fluid line to adjust the phase relationship between the cylinder body and piston movements to control the volumetric output of the pump while maintaining the desired value of the liquid's pressure in the pressurized-fluid line.

4. The pump of claim 1 wherein the piston moving means includes a first motor, and a first rotating hub driven by said first motor, said piston being eccentrically coupled to said first rotating hub so that the first rotating hub imparts the reciprocating movement to the piston.

5. The pump of claim 4 including first crank plate means eccentrically mounted to said first rotating hub, first connecting rod means having a proximal end coupled to the crank plate means and a distal end coupled to the piston, and first pin means coupling the rod to the crank plate means and piston so that said proximal end undergoes rotational movement with the crank plate means while said distal end pivots with respect to the piston and moves axially therewith.

6. The pump of claim 4 wherein the cylinder moving means includes a second motor, and a second rotating hub driven by said second motor, said cylinder body being eccentrically coupled to said second rotating hub so that the second rotating hub imparts the reciprocating movement to the cylinder body.

7. The pump of claim 6 including second crank plate means eccentrically mounted to said second rotating hub, second connecting rod means having a proximal end coupled to the second crank plate means and a distal end coupled to the cylinder body, and second pin means coupling the rod to the crank plate means and cylinder body so that said proximal end undergoes rotational movement with the second crank plate means while said distal end pivots with respect to the cylinder body and moves axially therewith.

8. The pump of claim 1 wherein the piston moving means includes a motor, a rotating cam driven by said motor about an axis of rotation, and having a generally non-concentrically contoured periphery, cam follower means for tracing said rotating cam periphery and transmitting the resultant motion, and connecting rod means having a distal end coupled to the piston and a proximal end responsive to said cam follower so that the motion of the cam follower is transmitted to the connecting rod.

9. The pump of claim 1 wherein the cylinder body moving means includes a motor, a rotating cam driven by said motor about an axis of rotation, and having a generally non-concentrically contoured periphery, cam follower means for tracing said rotating cam periphery and transmitting the resultant motion, and connecting rod means having a distal end coupled to the cylinder body and a proximal end responsive to said cam follower so that the motion of the cam follower is transmitted to the connecting rod.

10. The pump of claim 1 including a motor, a pair of rotating cams driven by said motor about an axis of rotation, and having respective generally non-concentrically contoured peripheries, a pair of cam follower means for tracing a respective one of the rotating cam peripheries and transmitting the resultant motion, first connecting rod means having a distal end coupled to the piston and a proximal end responsive to one of said cam follower means so that the motion of said one cam follower is transmitted to the first connecting rod means, second connecting rod means having a distal end coupled to the cylinder body and a proximal end responsive to the other of said cam follower means so that the motion of said other cam follower means is transmitted to the second connecting rod means, and an adjustable coupling responsive to the pressure variation in the high pressure line to vary the phase relationship between the two cams.

11. The pump of claim 1 including a constant speed motor for driving a selected one of the piston and cylinder body, pressure sensing means for monitoring the pressurized fluid pressure and producing a feedback signal indicative of same, and means for adjusting the relative position of the reciprocating piston within the reciprocating cylinder body in response to the feedback signal from the pressure sensing means so that the volume of fluid drawn into and compressed within the cylinders varies with pressure to maintain the desired working pressure level.

12. A power producing device comprising:

a body having at least one generally axially-extending cylinder, a high pressure piston within said cylinder and reciprocally movable therein between first and second positions, inlet means for permitting the ingress of a fluid into the cylinder as the piston moves away from the first position towards the second position, combustion means for igniting the fluid in the cylinder and thereby create volumetrically-expanding force within same;

outlet means for permitting the egress of the combusted fluid from the cylinder into an exhaust line;

means for reciprocally moving the piston axially within the cylinder, means for reciprocally moving the cylinder body axially, and means for adjusting the phase relationship between the cylinder body and piston movements to generally offset changes to a desired value of a monitored parameter.

13. For use with a high pressure pump of the type having a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, and means for reciprocally moving the piston axially within the cylinder, a method for offsetting pressure changes in the pressurized-fluid line as volumetric demand varies comprising the steps of:

reciprocally moving the cylinder body axially, and adjusting the phase relationship between the cylinder body and piston movements to adjust the volumetric output of the pump to generally maintain the desired value of fluid pressure in the pressurized-fluid line.

14. A pump comprising:

a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder body axially, and means for adjusting the phase relationship between the cylinder body and piston movements to adjust the volumetric output of the pump to adjust the volumetric output of the pump to generally maintain a desired value of the fluid pressure in the pressurized-fluid line, the adjusting means being responsive to the pressure in the pressurized-fluid line to adjust the phase relationship between the cylinder body and piston movements to control the volumetric output of the pump while maintaining the desired value of the liquid's pressure in the pressurized-fluid line.

15. A pump comprising:

a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder body axially, and means for adjusting the phase relationship between the cylinder body and piston movements to adjust the volumetric output of the pump to adjust the volumetric output of the pump to generally maintain a desired value of the fluid pressure in the pressurized-fluid line, the adjusting means including a motor, a pair of rotating cams driven by said motor about an axis of rotation, and having respective generally non-concentrically contoured peripheries, a pair of cam follower means for tracing a respective one of the rotating cam peripheries and transmitting the resultant motion, first connecting rod means having a distal end coupled to the piston and a proximal end responsive to one of said cam follower means so that the motion of said one cam follower is transmitted to the first connecting rod means, second connecting rod means having a distal end coupled to the cylinder body and a proximal end responsive to the other of said cam follower means so that the motion of said other cam follower means is transmitted to the second connecting rod means, and an adjustable coupling responsive to the pressure variation in the pressured-fluid line to vary the phase relationship between the two cams.

16. A pump comprising:

a body having at least one generally axially-extending cylinder, a high pressure piston within said cylinder and reciprocally movable therein between first and second positions, inlet means for permitting the ingress of a fluid into the cylinder as the piston moves away from the first position towards the second position, outlet means for permitting the egress of the fluid from the cylinder into a pressurized-fluid line after the fluid has been pressurized by the movement of the high pressure piston away from the second position towards the first position, means for reciprocally moving the piston axially within the cylinder, means for reciprocally moving the cylinder body axially, a constant speed motor driving a selected one of the piston and cylinder body, and means for adjusting the phase relationship between the cylinder body and piston movements to adjust the volumetric output of the pump to adjust the volumetric output of the pump to generally maintain a desired value of the fluid pressure in the pressurized-fluid line, the adjusting means including pressure sensing means for monitoring the pressurized fluid pressure and producing a feedback signal indicative of same, and means for adjusting the relative position of the reciprocating piston within the reciprocating cylinder body in response to the feedback signal from the pressure sensing means so that the volume of fluid drawn into and compressed within the cylinders varies with pressure to maintain the desired working pressure level.

* * * * *